US007107704B2

(12) United States Patent
Dennis et al.

(10) Patent No.: US 7,107,704 B2
(45) Date of Patent: Sep. 19, 2006

(54) CUSHIONING SHOE INSOLE

(75) Inventors: Mike Dennis, Scappoose, OR (US); Russell A. Monk, Salem, OR (US)

(73) Assignee: MJD Innovations, L.L.C., Scappoose, OR (US)

( * ) Notice: Subject to any disclaimer, the term of this patent is extended or adjusted under 35 U.S.C. 154(b) by 36 days.

(21) Appl. No.: 10/003,122

(22) Filed: Nov. 14, 2001

(65) Prior Publication Data

US 2002/0144432 A1 Oct. 10, 2002

Related U.S. Application Data

(60) Provisional application No. 60/281,604, filed on Apr. 4, 2001.

(51) Int. Cl.
*A43B 13/18* (2006.01)

(52) U.S. Cl. ..... 36/44; 36/28

(58) Field of Classification Search ..... 36/43, 36/44, 28

See application file for complete search history.

(56) References Cited

U.S. PATENT DOCUMENTS 3,500,472 A 3/1970 Castellani
4,006,542 A * 2/1977 Larson ..... 36/43
4,130,948 A 12/1978 Krug
4,136,226 A 1/1979 Gilman
4,504,604 A 3/1985 Pilkington et al.
4,558,470 A 12/1985 Mitchell et al.
4,561,140 A 12/1985 Graham et al.
4,627,114 A 12/1986 Mitchell
4,633,598 A 1/1987 Moronaga et al.
4,691,782 A 9/1987 Stine
4,695,496 A 9/1987 Lee
4,722,946 A 2/1988 Hostettler
4,808,469 A 2/1989 Hiles
4,872,220 A 10/1989 Haruvy et al.
4,874,640 A 10/1989 Donzis
4,876,805 A 10/1989 Peoples
4,980,386 A 12/1990 Tiao et al.
4,993,076 A 2/1991 Dierickx
5,014,041 A * 5/1991 Rosen ..... 36/43
5,098,421 A 3/1992 Zook
5,274,846 A 1/1994 Kolsky
5,319,867 A * 6/1994 Weber ..... 36/44
5,330,249 A 7/1994 Weber et al.
5,423,087 A 6/1995 Krent et al.
5,439,733 A 8/1995 Paire
5,463,824 A * 11/1995 Barna ..... 36/44
5,653,921 A 8/1997 Jenkner
5,655,226 A 8/1997 Williams
5,714,229 A * 2/1998 Ogden ..... 36/44
5,741,568 A 4/1998 Rudy
5,881,395 A 3/1999 Donzis
5,946,825 A * 9/1999 Koh et al. ..... 36/44
6,048,810 A * 4/2000 Baychar ..... 36/44
6,195,917 B1 * 3/2001 Dieckhaus ..... 36/44

OTHER PUBLICATIONS

7-Page collection of "PORON" commercial advertising.
2-Pages re PORON 90 (undated -5-pages generally (dated 1997).

* cited by examiner

*Primary Examiner*—Ted Kavanaugh
(74) *Attorney, Agent, or Firm*—Jon M. Dickinson PC; Robert D. Varitz PC

(57) ABSTRACT

A shoe insole structure which includes a non-springy, acceleration-rate-sensitive viscoelastic cushioning layer carrying, on its upper surface, a low-friction, abrasion-resistant, load-distributing, moisture-wicking overlayer.

4 Claims, 1 Drawing Sheet

CUSHIONING SHOE INSOLE

CROSS-REFERENCE TO RELATED APPLICATION

This application claims priority to Provisional Application Ser. No. 60/281,604, filed on Apr. 4, 2001, for "Cushioning Shoe Insole," which application is hereby incorporated by reference.

BACKGROUND AND SUMMARY OF THE INVENTION

This invention relates to a new and advantageous shoe insole, and in particular to such an insole which is usable in many shoe environments as, for example, in "sporting" shoes to offer a unique and superior combination of cushioning support, shock-absorbing response, moisture wicking, and related cooling. The invention, in relation to its cushioning and shock-absorbing qualities, rests in part on the concept that a superior insole structure can be formed utilizing a material which (a) flows with heat to conform topographically and fittingly to a generally "continuously" applied deforming force, such as that presented by weight on the foot, and (b) when deforming and responding in reaction to rapidly applied, shock-like forces, exhibits essentially no spring-like behavior in doing so. While the choice of a heat-flowable conforming material in a shoe is recognized to be advantageous in many settings, the selection of a material offering such a low rebound reaction, i.e., one without any appreciable spring-like behavior to shock-like events, is largely counter-intuitive today in the world of shoe construction.

A preferred embodiment of the proposed insole includes two cooperative layers—a lower layer formed of a microcellular, acceleration-rate-sensitive, viscoelastic, urethane material, and approximately joined thereto, an upper overlayer formed of a low-friction, wear-resistant, moisture-wicking fabric material, which also includes elongate fibres that contribute to shock load distribution.

The various important structural and performance features of the invention will become readily apparent as the description which now follows is read in conjunction with the accompanying drawings.

DETAILED DESCRIPTION OF THE INVENTION

Figure 1:
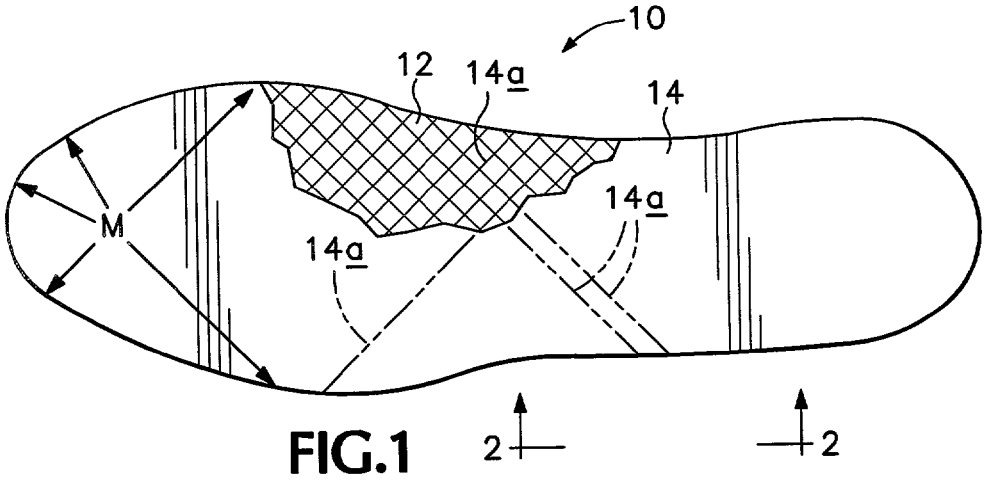
FIG. 1 is a simplified plan view illustrating an isolated shoe insole which is constructed in accordance with the present invention.
Figure 2:
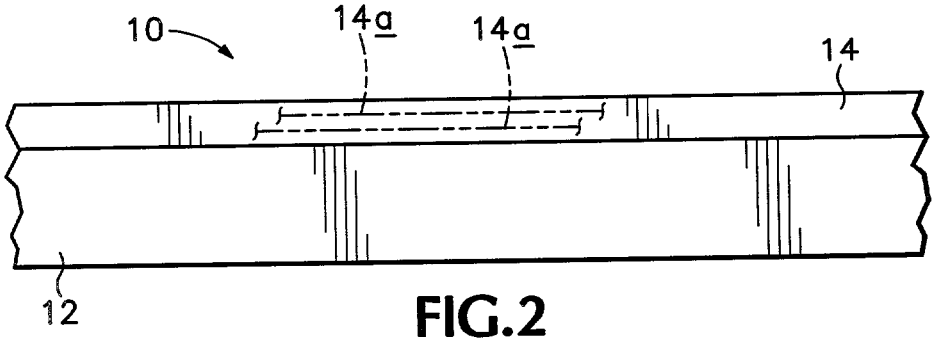
FIG. 2 is an enlarged, fragmentary side elevation taken generally along line 2—2 in FIG. 1.

Turning now to the drawing figures, the proposed insole structure of this invention is indicated generally at 10. For the purpose of convenience herein, insole 10 is pictured and described in a form wherein it is employable as a free insert for an already constructed shoe. It should be understood, however, that the insole of this invention could easily be incorporated as a part of initial shoe construction.

Insole 10 includes a heat-flowable, anti-spring-back, shock (acceleration)-rate-sensitive cushioning underlayer (or layer) 12, formed preferably of a material such as the microcellular, viscoelastic, urethane material known as PORON® 4000 Performance Urethanes, Series 90, Formation #94. This particular material is manufactured by Rogers Corporation in Woodstock, Conn. FIG. 1 shows the perimetral outline (the perimeter) of the overall expanse of insole 10, and as will shortly become apparent, two key layers which make up the insole extend substantially throughout the entirety of this expanse.

Layer 12, formed preferably from a material like that just specifically identified, has a shock cushioning behavior whereby (a) it deforms in an acceleration-rate-sensitive manner (the greater the acceleration, the slower the responsive deflection), and (b) returns slowly from such a deformation toward an undeformed condition without exhibiting any appreciable spring-like mannerisms. A spring-action response to a deflection, as such is now being discussed in relation to the present invention, occurs where a material effectively reacts to, and tends to return from, a force/impact deflected condition with a felt return force, and in a time-frame, that generally match those of the event which has produced the subject deflection. A non-spring-like response, which is characteristic of layer 12, takes the form of a return (from a shock-force/impact deflection) that is retarded over time, and characterized by a lowered, overall-felt, return-force behavior. In a sense, a material behaving in this non-spring-like manner tends to "creep" back toward an undeformed condition. This is how layer 12 behaves in insole 10.

Another important advantage which is offered by layer 12, formed with a material like that mentioned above, is that it tends to flow (at a creep) with heat and compression, and thus tends to deform gradually to create an upwardly facing, topographically-conforming, foot-support surface which tends to complement and "follow" the configuration of the underside of a supported foot.

Layer 12 herein preferably has a thickness of roughly of about 3/16-inches—a thickness which has been found to be quite appropriate in many insole applications.

Suitably surface-bonded to the upper surface of layer 12 is a thin fabric moisture-wicking, low-surface-friction and abrasion-wear layer 14. Preferably, layer 14 is formed of a woven-fibre fabric material known as HEATHERSTONE®, made by Lee Fashion Fabrics, Inc., in Gloversville, N.Y. Fabric layer 14 herein has a thickness preferably of about 1/64-inches, and includes elongate, stretch-resistant fibres (see 14*a* in the figures) that function as tension-active, load-distributing components in the fabric.

Layer 14 plays several important cooperative roles (i.e., cooperative with layer 12) in insole 10. One of these involves furnishing a wear surface to protect the longevity of the underlying cushioning layer, and to do so without appreciably diminishing the cushioning and shock-absorbing capabilities of that layer. Another involves furnishing a surface which has a low coefficient of sliding friction, so as to minimize friction heat which develops around the foot of a user during normal shoe use. A third important function for this layer is that it wicks moisture which typically develops in a shoe, and carries this moisture efficiently to the side edges (perimeter) of the insole where that moisture can quickly evaporate, and in so doing, provide cooling within a shoe. A fourth significant function of layer 14 is that its fibres act as elongate load-distributing elements that aid in spreading localized load events to a broader area within insole 10.

As was pointed out above, the material which makes up cushioning layer 12 responds to shock-force/impact loading in such a fashion that it has a tendency to return from a deformation (produced by such loading) in a retarded, slow and low-return-force (non-springy) fashion. This "low return-force" behavior is evidenced by the material returning toward an undeformed (unshockdeformed) condition without displaying anywhere near the same level of local return force or pressure which characterizes the initial loading per se.

Figure 3:
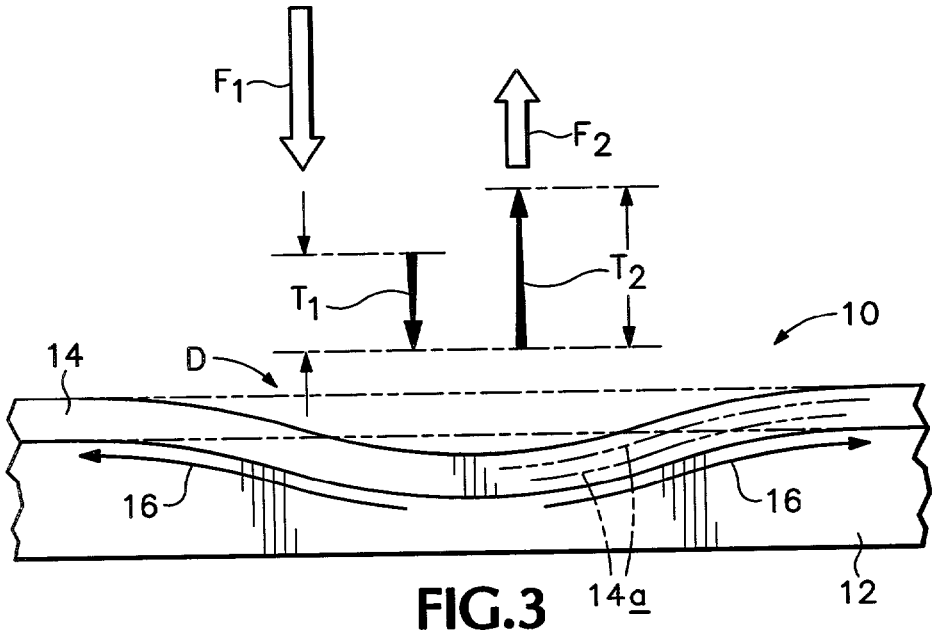
FIG. 3 is a view somewhat like that presented in FIG. 2, generally illustrating how the insole of FIGS. 1 and 2 provides anti-spring-like cushioning, and shock-absorbing.

FIG. 3 is presented to highlight this important performance of layer 12 in insole 10. In solid lines in this figure, layers 12, 14 are shown representationally shock-deflected to produce the combined deformation generally indicated as a depression at D. Dash-double-dot lines show the undeformed, "prior" dispositions of the local upper surfaces of these two layers.

Short, solid, downwardly-pointing arrow $T_1$, and long, shaded, downwardly-pointing arrow $F_1$ represent related time-span and applied-force characteristics, respectively, of the shock event which has produced deformation D. Long, solid, upwardly-pointing arrow $T_2$, and short, shaded, upwardly-pointing arrow $F_2$ represent the related time-span and return-force characteristics, respectively, of how layer 12, in cooperation with layer 14, will try to return from the shock-deformed state. As can be seen, $T_2$ is greater in length than is $T_1$, and $F_1$ is greater in length than is $F_2$. These comparative and differentiated "lengths" represent the time-span and force-level behavior characteristics which characterize the kind of non-spring-factor cushioning response that produces, respectively, the remarkable shoe-cushioning performance offered by the present invention. Fibres 14*a*, as indicated cooperatively by reverse arrows 16 in FIG. 3, act to distribute and spread load laterally in the insole.

The several outwardly pointing arrows which radiate from the letter M in FIG. 1 represent how moisture is wicked by layer 14 to the lateral (perimetral) edges of insole 10—the perimeter of the insole. At the perimeter of the insole such wicked moisture readily evaporates, and introduces effective and noticeable cooling in a shoe equipped with the insole.

The insole thus proposed by the present invention offers some very special advantages in relation to conventional insoles. Its construction is quite simple, and it lends itself readily to initial incorporation, and even retrofitting, in many otherwise conventional shoe designs. Heating of layer 12 during normal use causes the upper surface of the layer to form-fit the underside of a user's foot. Acceleration-rate-sensitivity in the layer leads to significant anti-springback behavior, and contributes to a remarkable ability of the insole of the invention to cushion shock loads. Fabric layer 14 acts as a low-friction, abrasion-resistant upper surface in the insole, protecting layer 12 from undue early wear, and minimizing friction-induced heat build up as the foot naturally moves around in a shoe. The significant moisture-wicking capability of layer 14 draws moisture away from beneath the foot, transporting it to the perimeter of the insole where cooling evaporation takes place.

While the invention has been disclosed in a particular setting, and in particular forms herein, the specific embodiments disclosed, illustrated and described herein are not to be considered in a limiting sense. Numerous variations, some of which have been discussed, are possible. Applicants regard the subject matter of their invention to include all novel and non-obvious combinations and subcombinations of the various elements, features, functions and/or properties disclosed herein. No single feature, function, element or property of the disclosed embodiments is essential. The following claims define certain combinations and subcombinations which are regarded as useful, novel and non-obvious. Other such combinations and subcombinations of features, functions, elements and/or properties may be claimed through amendment of the present claims or through presentation of new claims in this or in a related application. Such amended and/or new claims, whether they are broader, narrower or equal in scope to the originally presented claims, are also regarded as included within the subject matter of applicants' invention.

The invention claimed is:

1. A non-spring-back shoe insole comprising cushioning layer structure fully responsible for all cushioning behavior in the insole, structurally limited, with regard to cushioning-action response by it to a load-induced deformation, solely to a non-spring-back response, with said cushioning layer structure having upper and lower surfaces, and being formed throughout of an acceleration-rate-sensitive, viscoelastic, non-springy cushioning material, which, when a force is applied perpendicular to the cushioning layer structure, effectively densifies, thereby preventing total compression of the cushioning layer structure, and a moisture-wicking fabric overlayer joined to said upper surface, which provides (1) a wear surface to protect the longevity of the underlying cushioning layer structure, (2) a low coefficient of sliding friction to minimize friction-induced heat from the foot of the wearer, (3) wicking of moisture to the perimeter of the insole, and (4) load-distributing elements to spread localized load events over an overlayer surface, and wherein said moisture-wicking fabric overlayer cooperates with said cushioning layer structure to enhance shock absorbing characteristics thereof.

2. The non-spring-back shoe insole of claim 1 wherein said moisture-wicking fabric overlayer includes elongate, stretch resistant fibers which function as tension-active, load distributing components in the fabric, and which are oriented at about 45° to a long axis of the insole and at about 90° to one another.

3. A non-spring-back shoe insole comprising cushioning layer structure fully responsible for all cushioning behavior in the insole, structurally limited, with regard to cushioning-action response by it to a load-induced deformation, solely to a non-spring-back response, with said cushioning layer structure having upper and lower surfaces, and being formed throughout of an acceleration-rate-sensitive, viscoelastic, non-springy cushioning material, wherein said cushioning layer structure tends to flow with heat and compression, thus deforming gradually to create an upwardly facing, topographically-conforming, foot-support surface which compliments and follows the configuration of the underside of a supported foot, which, when a force is applied perpendicular to the cushioning layer structure, effectively densifies, thereby preventing total compression of the cushioning layer structure, and a moisture-wicking fabric overlayer joined to said upper surface, which provides (1) a wear surface to protect the longevity of the underlying cushioning layer structure, (2) a low coefficient of sliding friction to minimize friction-induced heat from the foot of the wearer, (3) wicking of moisture to the perimeter of the insole, and (4) load-distributing elements to spread localized load events over an overlayer surface, and wherein said moisture-wicking fabric overlayer cooperates with said cushioning layer structure to enhance shock absorbing characteristics thereof.

4. The non-spring-back shoe insole of claim 3 wherein said moisture-wicking fabric overlayer includes elongate, stretch resistant fibers which function as tension-active, load distributing components in the fabric, and which are oriented at about 45° to a long axis of the insole and at about 90° to one another.

* * * * *